US006453639B1

(12) United States Patent
Sgubbi

(10) Patent No.: US 6,453,639 B1
(45) Date of Patent: Sep. 24, 2002

(54) MACHINE FOR MAKING FILTER BAGS FOR PRODUCTS FOR INFUSION

(75) Inventor: Cristian Sgubbi, Imola (IT)

(73) Assignee: I.M.A. Industria Macchine, Bologna (IT)

( * ) Notice: Subject to any disclaimer, the term of this patent is extended or adjusted under 35 U.S.C. 154(b) by 117 days.

(21) Appl. No.: 09/584,146

(22) Filed: May 31, 2000

(30) Foreign Application Priority Data

Jun. 8, 1999 (IT) ..... BO99A0309

(51) Int. Cl.[7] ..... B65B 61/14; B31B 1/14

(52) U.S. Cl. ..... 53/134.2; 53/545; 493/343; 493/376; 493/357; 493/961

(58) Field of Search ..... 53/134.2, 372.4, 53/545, 548, 550; 493/345, 375, 357, 386, 210, 343, 376, 961; 206/0.5

(56) References Cited

U.S. PATENT DOCUMENTS 2,457,237 A * 12/1948 Howard ..... 53/134.2
2,939,257 A * 6/1960 Bartelt ..... 53/134.2
3,566,573 A * 3/1971 Irmscher ..... 53/134.2
3,774,369 A * 11/1973 Klar ..... 53/134.2
3,805,483 A * 4/1974 Romagnoli ..... 53/134.2
4,262,473 A * 4/1981 Brooke ..... 53/548
5,312,318 A * 5/1994 Vernon et al. ..... 53/134.2
5,863,575 A * 1/1999 Kuipers et al. ..... 206/5
5,870,880 A * 2/1999 Romagnoli ..... 206/5
5,871,789 A * 2/1999 Romagnoli ..... 53/134.2
5,893,256 A * 4/1999 Ghirlandi ..... 53/134.2

* cited by examiner

*Primary Examiner*—Stephen F. Gerrity
*Assistant Examiner*—Louis Huynh
(74) *Attorney, Agent, or Firm*—Arent Fox Kintner Plotkin & Kahn, PLLC

(57) ABSTRACT

A machine for making filter bags for products for infusion comprises a first wheel forming a station for winding a thread with pick-up tab around the filter bag, means for positioning and guiding the thread with pick-up tab relative to the filter bag operating along an arced path covered by the filter bag to allow the thread to be wound around the filter bag; the positioning and guiding means comprising a chute having a central channel to keep the thread with pick-up tab in a substantially stable and well-defined position relative to the filter bag traveling along the arced path.

16 Claims, 8 Drawing Sheets

4
8
9
30
49
F2
B
24
24'
22
220
23
2s'
2
7
2c
2
2b
110
21
9
15p
15
12
15
2
8
2s'
17
16
100
19
2
8
9
17
26
PA
8
9
2
27a
27
A
X
14
15
28b
13
28a
29
27b
25

17
16
2
2c
2s'
8
A
9
27
27b
25
18
17
15p
15
2b
2a
27a
8
28b
28a 26
18
2c
2s'
2
A
8
9
17
16
17
15p
2b
15
2a
17
14
8
18
26

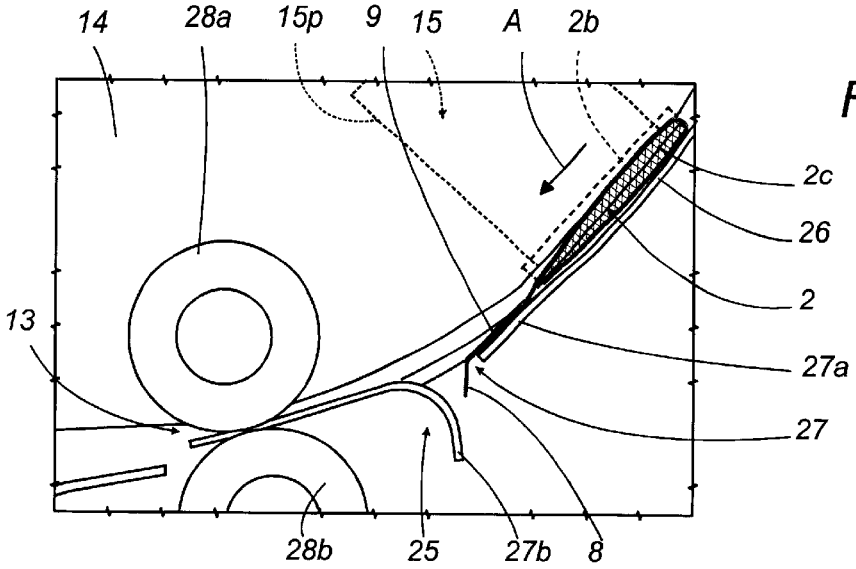
FIG.8
FIG.9
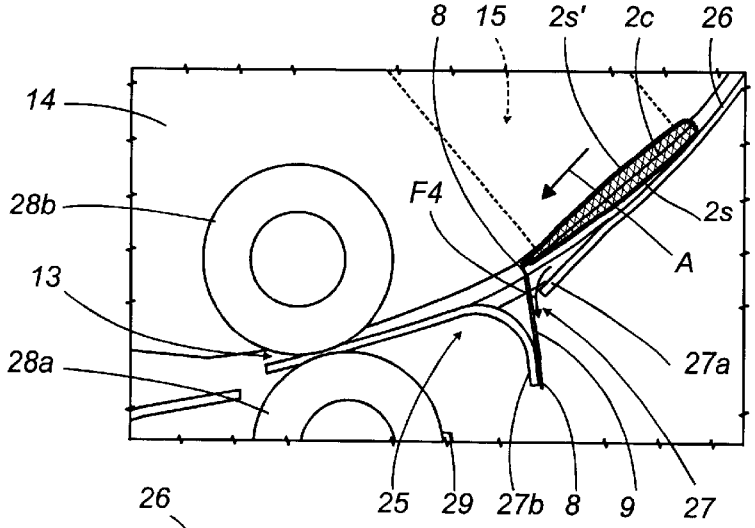
FIG.10
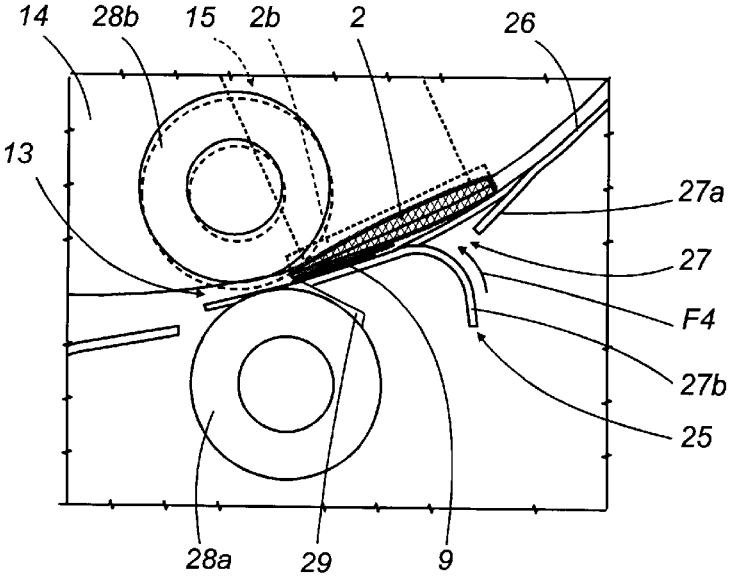

MACHINE FOR MAKING FILTER BAGS FOR PRODUCTS FOR INFUSION

BACKGROUND OF THE INVENTION

The present invention relates to a machine for making filter bags for products for infusion, such as tea, coffee, chamomile, etc.

In the present description, the filter bags of particular interest are of the single-lobe type (that is to say, with a single chamber which contains the product for infusion), with heat-sealing on three edges of the filter bag and folding of the fourth, with the addition of a thread and pick-up tab for the infusion process which is connected to the filter bag.

Known machines for making this type of product normally have: a reel which feeds a continuous web of heat-sealable material to a station at which the web is folded over itself to create a pocket which receives individual doses of the product for infusion arriving from a product dosing station; a station which seals three edges of the filter bag and heat-seals the thread with pick-up tab to the filter bag, the tab having been attached to one end of the thread at an attachment station; the thread and tab are prepared in a station located substantially at the side of the sealing station. There is also a station which cuts the individual filter bags and the thread with tab; a station for winding the thread with tab around the filter bag and simultaneously transferring the individual filter bags with wound thread and tab to an attachment station, which attaches the tab to one sealed edge, more specifically the end, of the filter bag.

Downstream of the latter station there may also be a station for preparation of outer wrappers for the filter bag; a station which stacks a preset number of filter bags with or without outer wrappers; and, finally, a station which packs groups of filter bags into boxes.

At present, machines of the type described above are limited from the point of view of operating speed in the production of filter bags in a given time.

These limitations are caused by the structure of some stations, in particular, the station which attaches the tab to the thread, the station which winds the thread with tab around the filter bag and the station which attaches the tab to the sealed end of the filter bag.

Both the station which attaches the tab to the thread and the station which attaches the label to the sealed end of the filter bag comprise gluing units for the application of an adhesive on an area of the tab and on an area of the sealed side of the filter bag, these gluing units making the attachment operations relatively slow and sometimes leaving adhesive waste or impurities on the product.

The station which winds the thread around the filter bags consists of a wheel which turns about its own horizontal axis, with a plurality of grippers evenly distributed along the circumference of the wheel and each designed to pick up an individual filter bag, whilst the thread and tab remain free close to the bag, that is to say, in contact with the outer surface of the wheel opposite that on which the grippers are fitted. As the wheel turns, this free pre-winding configuration tends to create a pendulum action by the thread and tab (with free, random positioning), which may cause the thread to go beyond the wheel or to a position which is not suitable for correct complete thread winding around the filter bag.

This pendulum action is accentuated as the machine speed increases, with a consequent increase in the speed at which the wheel turns. As a result, in order to keep the position of the thread with tab as correct as possible on the wheel, given that for winding transfer the thread must be centered relative to the filter bag, the machine production speed must be kept low.

The aim of the present invention is, therefore, to overcome the above-mentioned disadvantages by providing a machine designed for making filter bags for products for infusion whose production speed is decidedly higher than that of conventional machines, without completely changing the basic structure of the conventional machine.

SUMMARY OF THE INVENTION

Accordingly, a machine is provided for making filter bags for products for infusion comprising, close to a first wheel, which forms a station for winding a thread with pick-up tab around a filter bag, means which position and guide the thread with pick-up tab relative to the corresponding filter bag. The positioning means operate along an arced path covered by the filter bag in order to wind the thread with pick-up tab around it and said means can keep the thread with pick-up tab in a substantially stable and well-defined position relative to the filter bag along the arced winding path.

BRIEF DESCRIPTION OF THE DRAWINGS

The technical features of the present invention, in accordance with the above-mentioned aims, are set out in the claims herein and the advantages more clearly illustrated in the detailed description which follows, with reference to the accompanying drawings, which illustrate a preferred embodiment without limiting the scope of application, and in which:

FIGS. 8, 9 and 10 are schematic side views of a set of stages which can be performed in a station which attaches a pick-up tab to the filter bag, located downstream of the winding—transfer station illustrated in FIG. 1;

DESCRIPTION OF THE PREFERRED EMBODIMENTS

Figure 1:
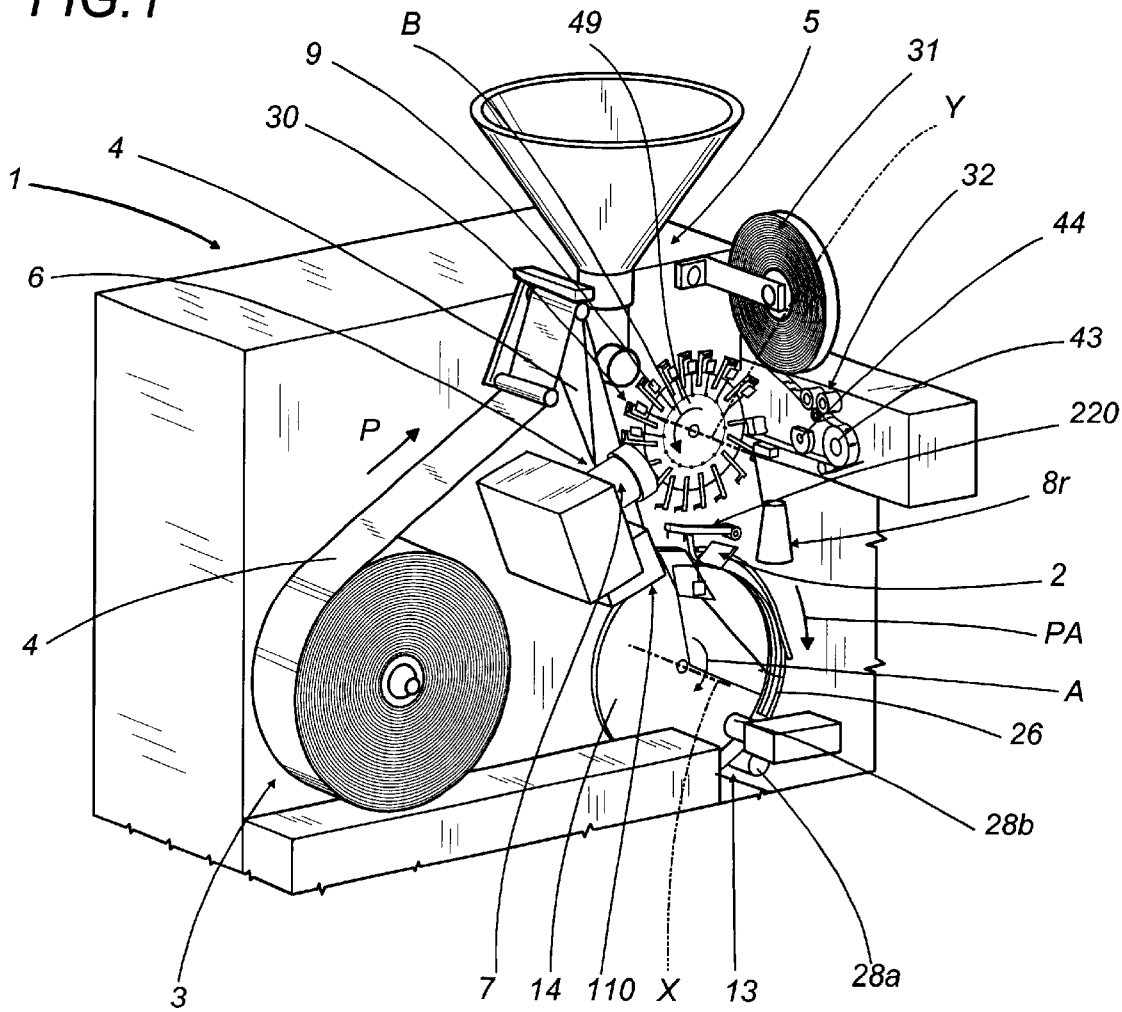
FIG. 1 is a schematic perspective view of a machine for making filter bags for products for infusion, made in accordance with the present invention.
Figure 14:
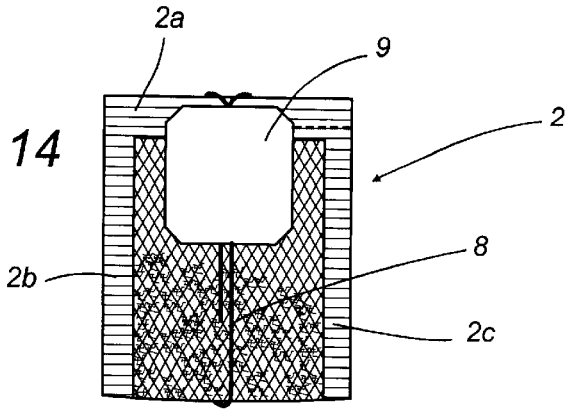
FIG. 14 is a front view of a filter bag made using the machine disclosed.

With reference to the accompanying drawings and in particular FIG. 1, the machine disclosed, labeled 1 as a whole, is used for making filter bags 2 for products for infusion (such as tea, coffee, chamomile, etc.) of the single-lobe type illustrated in FIG. 14, that is to say, with three sealed edges (two sides and one end), with the base folded to form a small expanding area, and with a thread 8 with pick-up tab 9, wound around the filter bag 2.

The machine 1 basically comprises a station 3 which feeds a continuous web of heat-sealable film 4 along a given path P. The web can be folded over itself at a station 5 which distributes the product for infusion into individual doses in the folded film 4.

A station 6 which, by means of heat-sealing, forms a continuous strip of sealed filter bags 2, positioned one after another. At a subsequent attachment station 7, the end of a portion of thread 8, the other end of which is attached to the pick-up tab 9, is attached to each filter bag 2.

The thread 8 and pick-up tab 9 arrive from a station 10 which unwinds the thread 8 and are attached to one another at a station 11 for attaching the pick-up tabs 9 to the thread 8.

Downstream of the above-mentioned station 7 which attaches the thread 8 to the filter bag 2, in the direction of film 4 feed along the path P, there is a station 110 which cuts the individual filter bags 2 from the continuous strip of filter bags 2 and, cuts the portion of thread 8, preset by unwinding on the relative station 10, with the pick-up tab 9 from the unwinding station 10.

The individual filter bags 2 with the thread 8 and pick-up tab 9 are released in a station 12 which winds the thread 8 with pick-up tab 9 around the relative filter bag 2. Downstream of this station 12 is a station 13 which attaches the pick-up tab 9 to one sealed edge 2*a,* more specifically the end, of the filter bag 2.

Upon completion of this operation, the filter bag 2 can be released in a station which wraps the individual filter bags 2 in an outer wrapper and/or in a station which packs preset groups of filter bags into boxes (not described or illustrated here, since it does not form part of the subject matter of the present invention).

Figure 6:
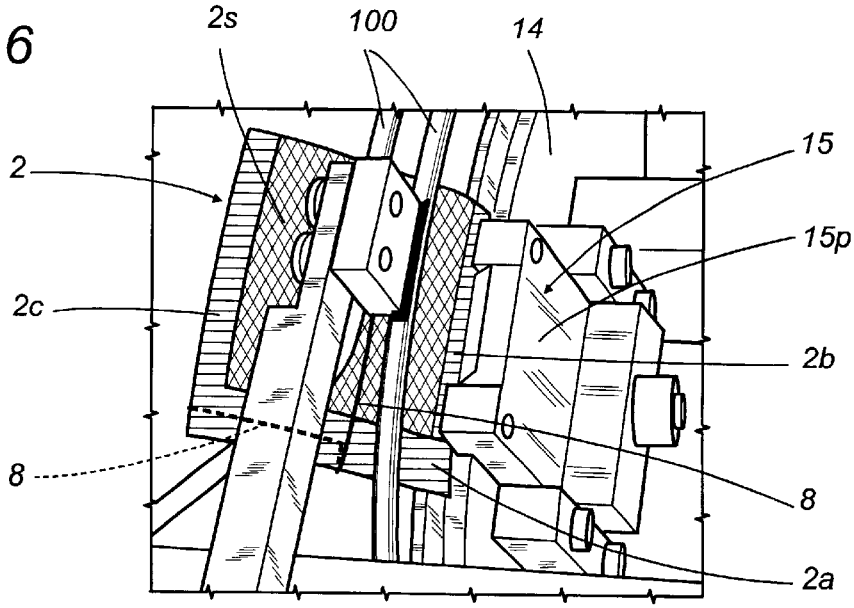
FIG. 6 is a perspective view of the gripper means which are part of the station illustrated in FIG. 1.

More specifically in terms of technical details (see FIG. 2), the winding station 12 comprises a first wheel 14 which turns about its axis X, having a plurality of gripper means 15 for gripping filter bags 2 by one sealed edge 2*b* (see FIG. 6). These gripper means 15 consist of grippers 15*p* (see FIG. 6 in particular) attached to the first wheel 14 and evenly distributed over the surface of the first wheel 14 close to the outer circumference of the first wheel 14. The grippers 15*p* feed each filter bag 2 forward along an arced path, indicated by the arrow PA, and in a direction A, so as to allow the thread 8 with pick-up tab 9, located close to the filter bag 2, to be completely wound around the filter bag 2.

As is clearly illustrated in the FIGS. from 2 through 7, close to the first wheel 14 there are means 16 which position and guide the thread 8 with pick-up tab 9 relative to the corresponding filter bag 2. These means 16 substantially operate along the arced path PA to keep the thread 8 with pick-up tab 9 in a substantially stable and well-defined position relative to the filter bag 2 over the arced winding path PA.

More specifically, the positioning means 16 comprise a plurality of elements which, working together, allow correct and precise winding of the thread 8 with pick-up tab 9 around the filter bag 2, even if the machine is operating at high production speeds.

The elements basically comprise the positioning and guide means 16 and are: a guard 21 for initial thread 8 with pick-up tab 9 positioning, a unit 220 which pulls and pre-winds the thread 8 relative to the corresponding filter bag 2, a chute 17 and a support sector 19 for the thread 8 with pick-up tab 9.

Figure 2:
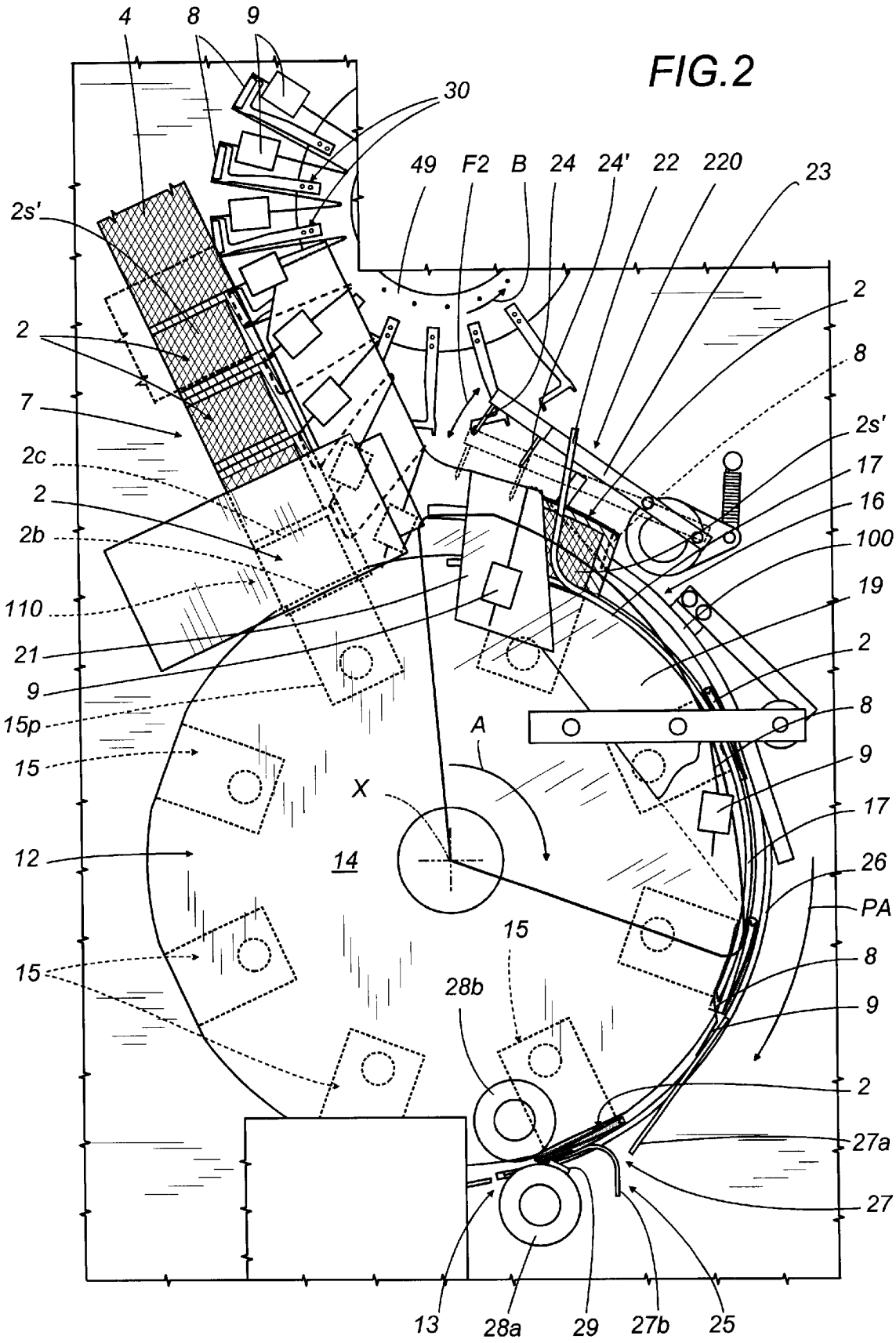
FIG. 2 is a schematic front view, with some parts cut away to better illustrate others, of part of the machine illustrated in FIG. 1, in particular a filter bag winding—transfer station.
Figure 4:
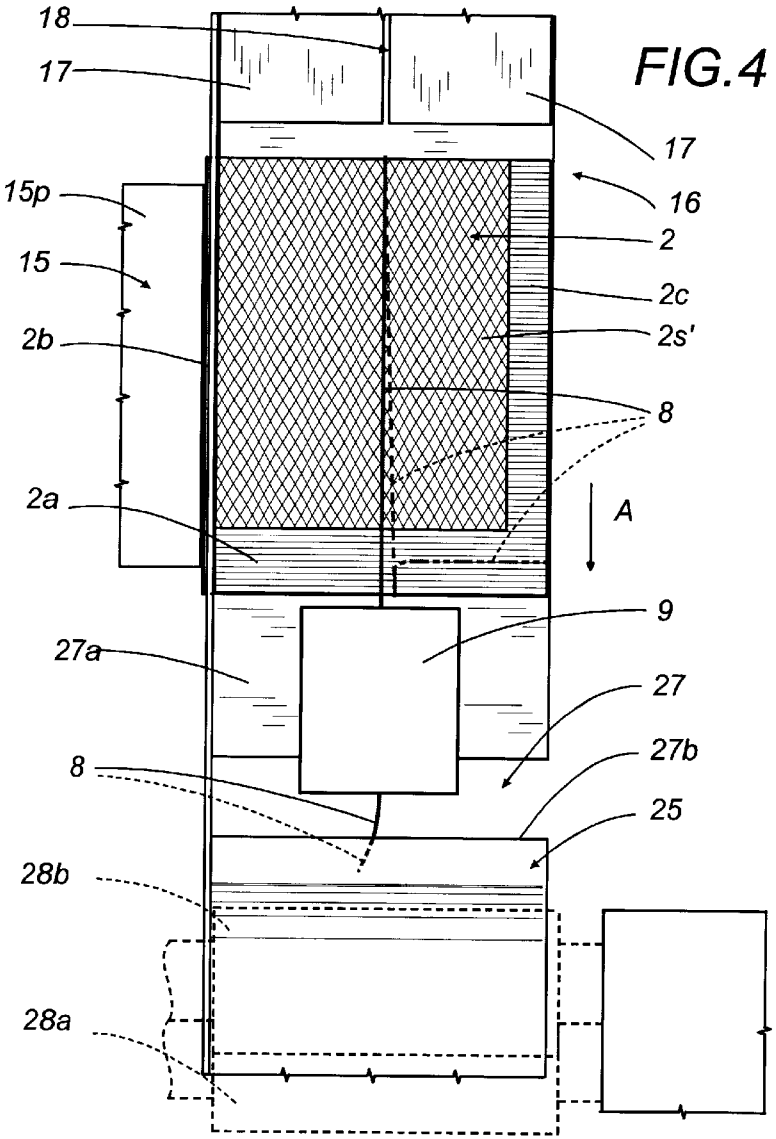
FIG. 4 is a front view, with some parts cut away, of another part of the station illustrated in FIG. 2.
Figure 5:
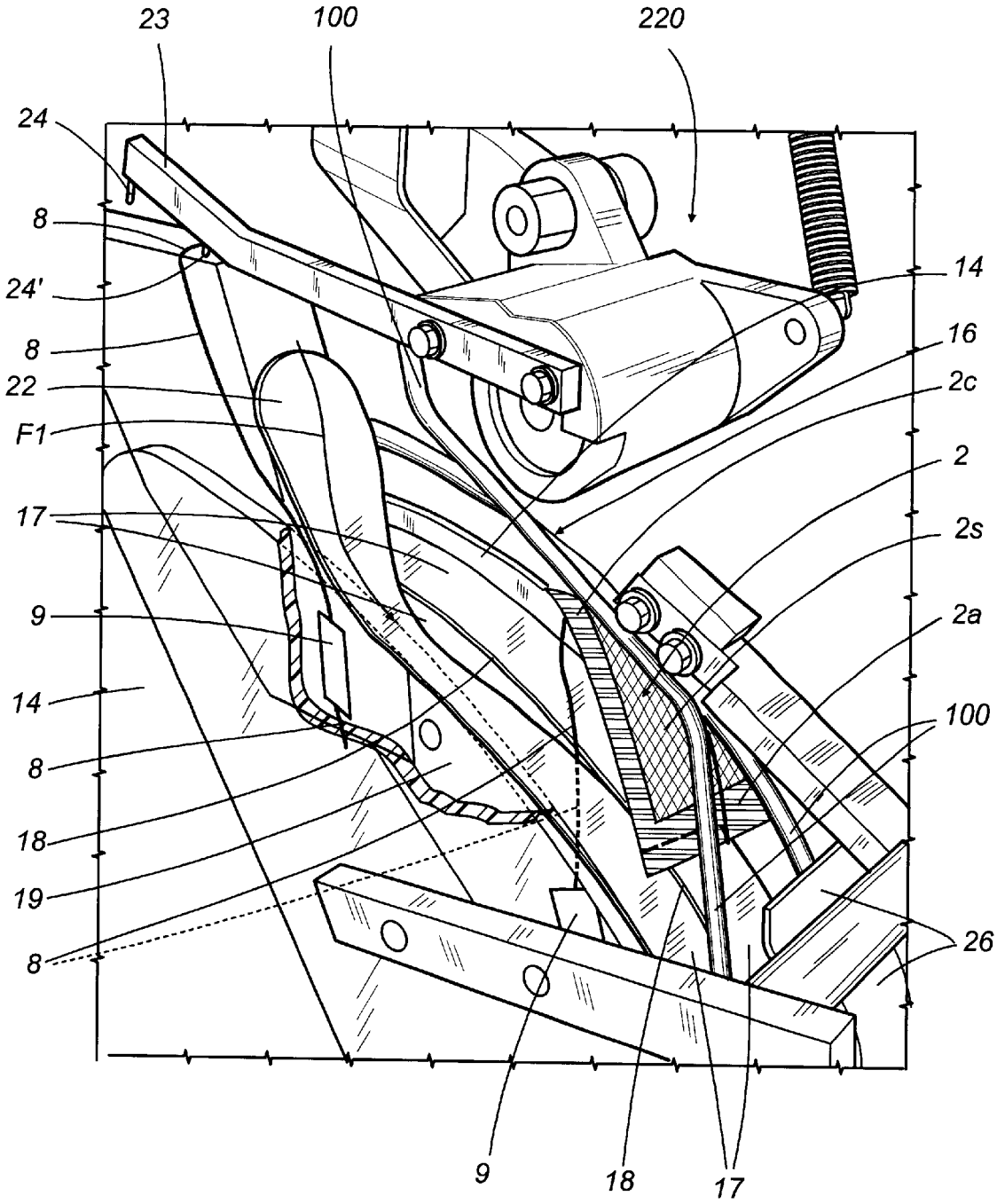
FIG. 5 is a perspective view of another detail of the station illustrated in FIG. 2.
Figure 7:
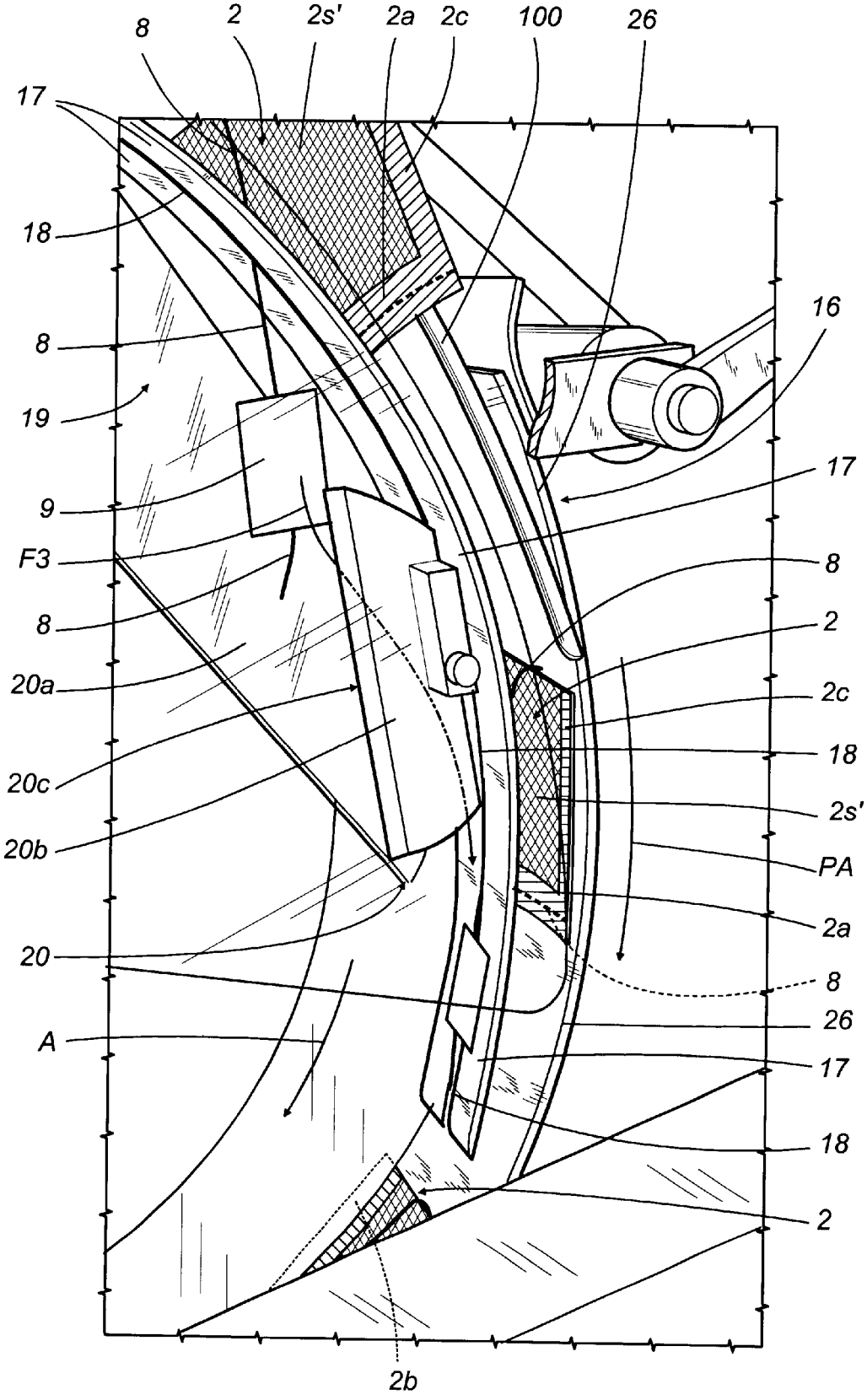
FIG. 7 is a perspective view, with some parts cut away to better illustrate others, of a detail of the lower part of the winding—transfer station illustrated in FIGS. 1 and 2.

More specifically, and following the direction of feed A of a filter bag 2 along the arced path PA, the guard 21 covers (as illustrated in FIGS. 2, 5 and 7) a sector in which the first wheel 14 passes close to a zone in which the filter bag 2 passes from the cutting station 110 to the winding station 12, where the filter bag 2 is grasped by the grippers 15*p*.

In practice, the cutting station 110 releases part of the thread 8 with pick-up tab 9 onto the guard 21 (see FIG. 2). This part of the thread falls onto the surface of the first wheel 14 opposite that on which the filter bag 2 pick-up grippers 15*p* are located. In this way, a first thread 8 pre-winding configuration is obtained on a first surface 2*s* of the filter bag 2, since the thread 8 remains in contact with the surface 2*s* of the filter bag 2 and projects beyond the other sealed edge 2*c* of the filter bag 2.

Again illustrated in FIG. 2, the guard 21 extends close to a front edge of the chute 17, whilst (see FIGS. 2 and 5), a first arm 22, fixed and projecting from the first wheel 14 and the guard 21 is designed to form a guide path (see arrow F1 in FIG. 5) for feeding the thread 8 into a central channel 18 in the chute 17 (described in more detail below).

Above the guard 21 is the unit 220 for pulling and pre-winding the thread 8 with pick-up tab 9 around the filter bag 2 (see FIGS. 2 and 5).

More specifically, the unit 220 is attached to the machine 1 load-bearing structure and close to the first wheel 14 and the guard 21. In addition to the first arm 22, the unit 220 consists of a second arm 23 with a pair of pins 24, 24' which intercept a corresponding section of thread 8, positioned on the guard 21, from two successive filter bags 2.

In order to obtain correct thread 8 tension, the second arm 23 oscillates (using known means, synchronized with the other machine stations and in particular with the first wheel 14), between a raised, non-operating position (illustrated in FIGS. 2 and 5), allowing the threads 8 with pick-up tabs 9 to move on freely (pulled by the forward motion of the filter bag 2), and in which the pins 24, 24' are distanced from the guard 21, and a close, operating position (see the dashed line in FIG. 2, arrow F2), in which the pins 24, 24' make contact with the guard 21, preventing the threads 8 from moving in direction A relative to the corresponding filter bag 2 as it moves forward, thus obtaining a configuration in which the threads 8 are taut relative to the filter bag 2 with improved contact between the thread 8 and the above-mentioned surface 2*s* of the filter bag 2. The pins 24 and 24' are located at a given distance from one another, so that correct thread 8 tension is maintained as they slide over the guard 21 and as far as the point at which the individual threads 8 are guided into the first chute 17.

Moving along the arced path PA, the chute 17 extends parallel with the arced path PA for filter bag 2 transit and allows separation of the track followed by the filter bags 2 (formed both by bars 100 which fold the filter bags 2 by approximately a right angle, and by an actual first track 26 which carries the filter bags 2 to the station 13 which attaches the pick-up tab 9 to the filter bag 2, both elements illustrated in FIGS. 5 and 6) and the corresponding zone for transit of the thread 8 with pick-up tab 9. More specifically, the chute 17 extends along most of the arced path PA and has the above-mentioned central channel 18 (see FIGS. 3, 4, 5 and 7) which allows thread 8 transit.

Figure 3:
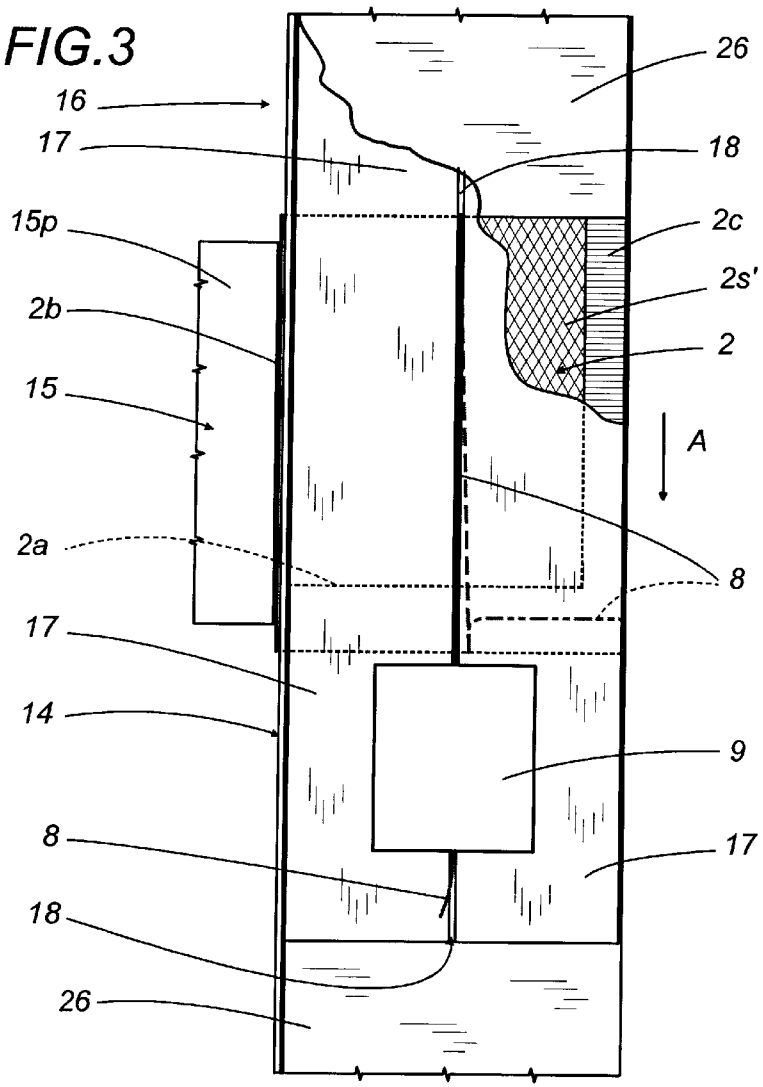
FIG. 3 is a front view, with some parts cut away, of part of the station illustrated in FIG. 2.

The thread 8 with pick-up tab 9 is guided along most of the arced path PA by the sector 19 upon which the projecting part of the thread 8 with pick-up tab 9 physically rests (see FIGS. 3, 7 and 8 in particular). This sector 19 is perpendicular to the chute 17 and extends along part of the chute 17 so as to tension and stabilize the thread 8 with pick-up tab 9 relative to the filter bag 2 as the latter is turned and positioned along a first track 26.

The final part of the sector 19 has a lower portion 20, relative to the direction of feed A, which tapers towards the chute 17 and is divided into two separate parts 20*a* and 20*b*, forming a transit slit 20*c* which correctly guides the thread 8 with pick-up tab 9 at the chute 17 (see arrow F3 in FIG. 7).

At the end of the chute 17, the thread 8 already wound around both surfaces 2*s* and 2*s*' of the filter bag 2 (see FIGS. 4, 7 and 8) and downstream of the filter bag 2 relative to the direction of feed A there is the pick-up tab 9, which must be folded under the filter bag 2.

This is possible thanks to a unit 25 which folds the pick-up tab 9 relative to the filter bag 2 close to the end of the arced path PA, that is to say, between the arced path PA and the station 13 which attaches the pick-up tab 9 to the filter bag 2.

More precisely, the folding unit 25 comprises a portion of the first support track 26 (see FIGS. 2, 8, 9 and 10) for the filter bag 2 and, in this case, also the thread 8 with pick-up tab 9. This portion of the first track 26 has a recess 27, formed by two disconnected segments 27*a* and 27*b* of the track 26, which takes up the pick-up tab 9 and is designed to allow the pick-up tab 9 firstly to be positioned below the first track 26 (see FIGS. 8 and 9), then recovery and folding of the pick-up tab 9 as the filter bag 2 passes the recess 27 (see FIG. 10, arrow F4), thus positioning the pick-up tab 9 between the filter bag 2 and the first track 26 on the surface 2s of the filter bag 2 and close to the top 2*a* of the filter bag.

At this point, the pick-up tab 9 is attached to the sealed end 2*a* by heat-sealing in the attachment station 13 (again see FIG. 10).

The station 13 which attaches the pick-up tab 9 (again see FIGS. 8, 9 and 10) comprises a pair of motor-driven rollers 28*a* and 28*b*, located on opposite sides of the first filter bag 2 transit track 26 and flexibly in contact with one another so as to better adhere to the filter bag 2 in transit. The lower roller 28*a* is the sealing element, synchronized with filter bag 2 feed and having a sector 29 designed to allow sealing compression on the folded pick-up tab 9 and on the sealed end 2*a* of the filter bag 2, whilst the other, upper roller 28*b* is a contrast for the sealing roller 28*a* which turns in the direction of feed A.

Upon completion of the attachment, the filter bag configured as illustrated in FIG. 14 is transferred to the stations which apply the outer wrapper and/or pack the filter bags into boxes (stations not illustrated).

As already indicated, the pick-up tab 9 is heat-sealed to the end 2*a* of the filter bag 2 and this type of heat-sealing operation is also used to attach the pick-up tab 9 to the thread 8.

This operation is performed at the station 11 for attaching the pick-up tab 9 to thread 8, which comprises a heat-sealing unit 34 designed to allow this attachment.

As illustrated in FIG. 1, the thread 8 unwinding station 10 comprises a second wheel 49 fitted with means 30 designed to create a thread 8 unwinding pattern (of the known type, such as retaining pegs and forks projecting from the wheel and designed to create a well-defined pattern in the thread 8 from a reel 8*r*).

This second wheel 49 turns about its axis Y in a direction B and carries a section of the thread 8 unwound close to the station 11 which attaches the pick-up tab 9 to the thread 8. In turn, the station 11 which attaches the pick-up tab 9 to the thread 8 comprises a reel 31 which feeds a continuous web S of pick-up tabs 9.

In addition to the reel 31, the pick-up tab 9 attachment station 11 comprises (see FIGS. 11, 12 and 13) a unit 32 which positions and forms individual pick-up tabs 9 close to the thread 8 transit zone; means 33 which fold the pick-up tab 9 over itself, in a direction of feed B, and intercept the section of thread 8, and the above-mentioned unit 34 which heat-seals the pick-up tab 9 to the section of thread 8.

More specifically, in terms of construction details (again see FIGS. 11, 12 and 13), the pick-up tab 9 positioning and forming unit 32 comprises a set of three motor-driven rollers, labeled 32*a*, 32*b*, 32*c*, designed to allow the feed, synchronized with the thread 8 unwinding station 10, of a preset quantity of the continuous web S of pick-up tabs 9, equivalent to a single pick-up tab 9, to a second feed track 35. This second feed track 35 extends as far as the thread 8 transit zone, in which there is a fork 36 which supports the end of the continuous web S. Finally, there are synchronized cutting means 37, designed to create an individual pick-up tab 9, supported by the fork 36, which is on the opposite side of the section of thread 8.

Figure 11:
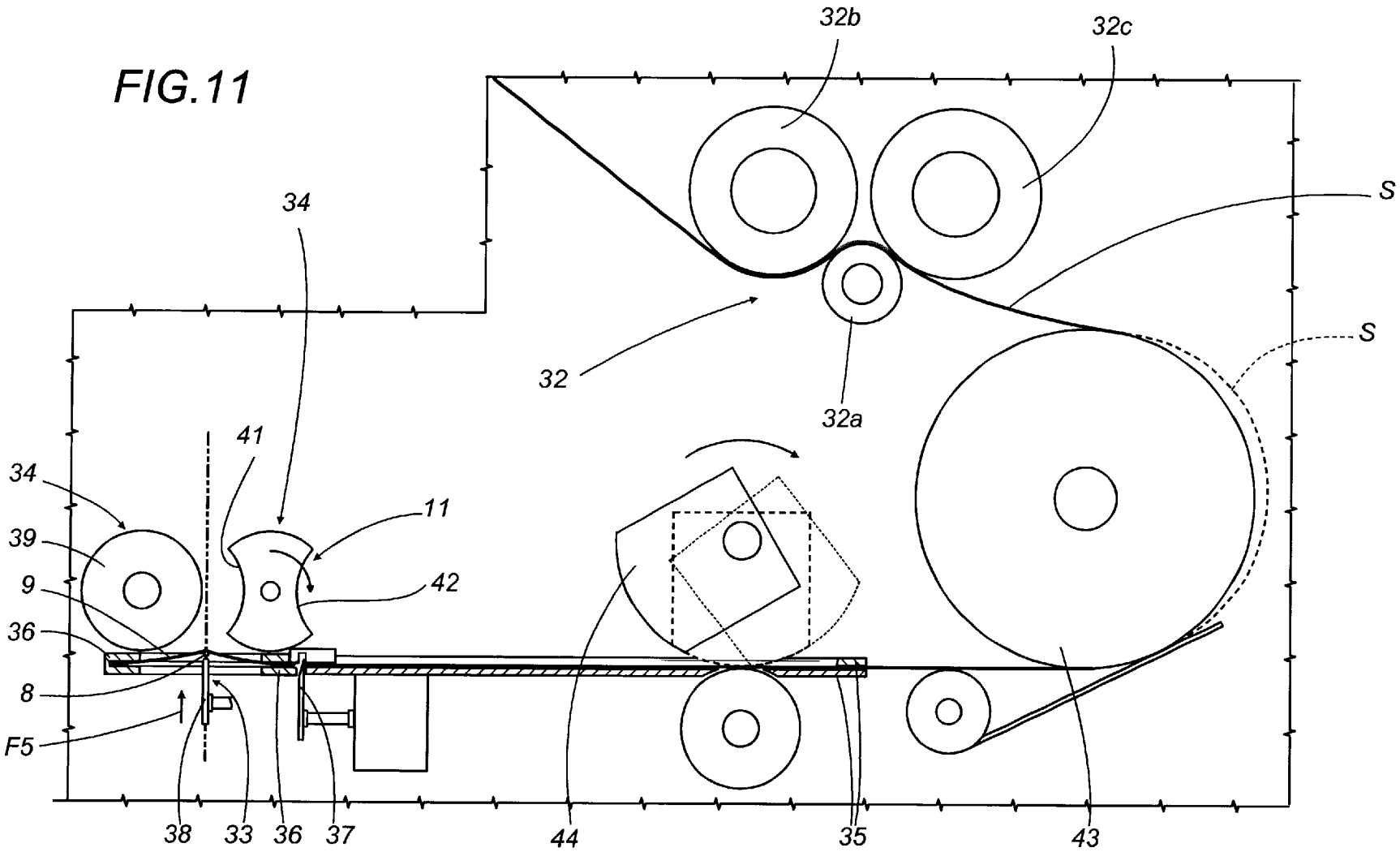
FIG. 11 is a schematic side view of a part of the machine disclosed, in particular, a station which attaches the tab to a thread.

The folding means 33 comprise a thin plate 38, located below the individual pick-up tab 9 supported by the fork 36, and mobile between a lowered, non-operating position (see FIGS. 12 and 13), in which the plate 38 is distanced from the individual pick-up tab 9, and a raised, operating position, in which the plate 38 intercepts the individual pick-up tab 9 and the section of thread 8, forming an inverted <<V>> configuration in the pick-up tab 9, into which the section of thread 8 is fitted (see FIG. 11, arrow F5).

The folding plate 38 is preferably moved in time with the blade 37 which constitutes the cutting means. The individual pick-up tab 9 is cut and, immediately afterwards, the pick-up tab 9 just created is folded.

The heat-sealing unit 34 comprises a pair of rollers 39 and 40, set opposite one another and both able to turn about respective axes. The roller labeled 39 is the sealing roller, whilst the roller labeled 40 is the contrast roller.

Figure 12:
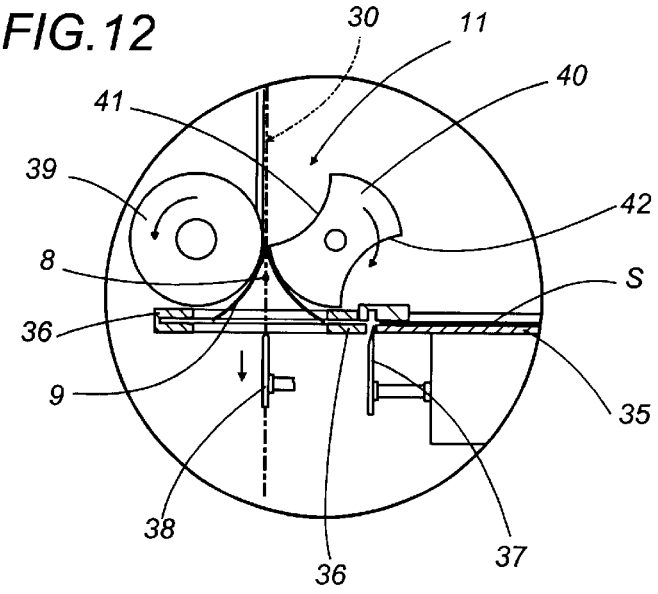
FIGS. 12 and 13 are schematic side views of a set of stages which can be performed by the station illustrated in FIG. 11 to allow the tab to be attached to the thread.
Figure 13:
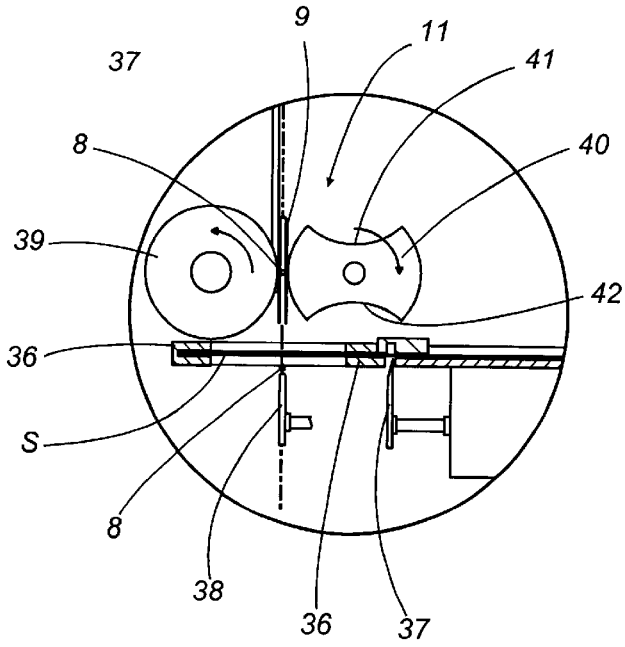

This pair of rollers 39 and 40 is located close to and above the fork 36 which supports the individual pick-up tab 9, and the rollers allow the pick-up tab 9 to be attached to the section of thread 8 after the individual pick-up tab 9 has been folded by the plate 38 which brings the pick-up tab 9 and the section of thread 8 into contact with the rollers 39 and 40, rotating in direction B (see FIGS. 12 and 13).

The contrast roller 40 has a pair of opposite recesses 41 and 42 on its cylindrical surface, so as to by-pass the forks projecting from the second thread 8 unwinding wheel 49 during non-operating rotation.

In order to feed the continuous web S correctly towards the pick-up tab 9 attachment zone in a reduced space, there is (see FIG. 11) an accumulation unit 43, consisting of a fixed roller, located between the set of three motor-driven rollers 32*a*, 32*b*, 32*c* and the cutting means 37, which allows the preset quantity of the web S to be unwound (see dashed line in FIG. 11) without thrusting the web S close to the second track 35, and stepping thrust means 44 for the continuous web S, located at the second track 35, and designed to allow the web to be fed, in time with the web S cutting means 37, towards the cutting means 37.

The machine made according to the present invention fulfils the stated aims thanks to a plurality of devices which, on one hand do not involve excessive change to the basic structure of the known type of machine, and on the other hand increase the production speed and the quality of the end product, even with the same machine overall dimensions and/or the same sized units.

The guide and positioning means allow a precise and correct thread feed with relative winding around the filter bag even at speeds higher than those previously used on this type of machine.

Heat-sealing the pick-up tab to the thread and to the end of the filter bag gives a product with improved quality, cleaner to make and maintains high machine productivity levels.

The invention described can be subject to modifications and variations without thereby departing from the scope of the inventive concept. Moreover, all the details of the invention may be substituted by technically equivalent elements.

What is claimed is:

1. A machine for making filter bags for products for infusion, comprising:

a station for feeding a continuous web of heat-sealable film folded over itself;

a station for distributing individual doses of the product for infusion in the folded film;

a station for forming a continuous strip of filter bags, each filter bag being sealed and positioned one after the other;

a thread unwinding station for supplying a continuous thread and a plurality of pick-up tabs;

a station for attaching one end of a respective pick-up tab to one end of a respective section of the thread;

an attachment station for attaching another end of the respective section of the thread to a respective filter bag;

a station for cutting both the respective filter bag from the continuous strip of filter bags and the respective section of the thread with the respective pick-up tab from the continuous thread;

a winding station for winding the respective section of the thread with the respective pick-up tab around the respective filter bag, the winding station comprising one wheel rotationally mobile about its own axis and gripper means for picking up the separated filter bags, said gripper means being evenly distributed over a surface of the wheel and disposed close to an outer circumference of the wheel for feeding the respective filter bag along an arced path and winding the respective section of the thread with the respective pick-up tab around the respective filter bag;

a station for attaching the pick-up tab to a sealed end of the respective filter bag; and means for positioning and guiding the respective section of the thread with the respective pick-up tab relative to the respective filter bag, said positioning and guiding means operatively associated with the wheel to keep the respective section of the thread with the respective pick-up tab in a substantially stable and well-defined position relative to the respective filter bag, said positioning and guiding means comprising a chute extending and operating along the arced path for separating the arced path for the respective filter bag from a corresponding transit zone for the respective section of the thread, said chute comprising a central channel allowing the respective section of the thread to transit there through.

2. The machine according to claim 1, wherein the positioning and guiding means further comprises a support sector for supporting a portion of the respective section of the thread and the respective pick-up tab, the support sector being substantially perpendicular to the chute and extending along part of the chute, thus allowing the respective section of the thread with the respective pick-up tab to be tensioned and stabilized relative to the respective filter bag, the support sector having a tapered lower portion towards the chute, and divided into two separate parts, defining a transit slit for guiding the respective section of the thread with the respective pick-up tab at the chute.

3. The machine according to claim 2, wherein the chute includes a first fixed arm projecting away from the wheel, and wherein the positioning and guiding means further comprises a guard located between the cutting station and the winding station for positioning the respective section of the thread with the respective pick-up tab on the guard on a surface of the wheel opposite to the surface carrying the gripper means, and for allowing a thread pre-winding configuration on a first surface of the respective filter bag, the guard extending to the first fixed arm of the chute to form a guide path for feeding the respective section of the thread with the respective pick-up tab into the central channel.

4. The machine according to claim 3, wherein the positioning and guiding means further comprises a unit for pulling and pre-winding the respective section of the thread with the respective pick-up tab around the respective filter bag, the pulling and pre-winding unit being located close to the wheel and the guard.

5. The machine according to claim 4, wherein the pulling and pre-winding unit includes a second arm having at least one pin for intercepting the thread on the guard, the second arm oscillating in synchronization with the wheel between a raised, non-operating position, in which the pin is distanced from the guard, and a close, operating position, in which the pin makes contact with the guard for blocking and tautening a portion of the respective section of the thread onto the first surface of the respective filter bag.

6. The machine according to claim 1, wherein the machine further comprises a unit for folding the respective pick-up tab onto the respective filter bag, the folding unit being operatively associated with the positioning and guiding means, the unit for folding being located close to a final section of the arced path, between the final section of the arced path and the station for attaching the respective pick-up tab to the respective filter bag.

7. The machine according to claim 6, wherein the folding unit comprises a track having a first portion of the track for supporting the respective filter bag and the respective section of the thread with the respective pick-up tab in a configuration such that the respective pick-up tab is disposed downstream of the respective filter bag in a direction of feed; a recess disposed downstream of the first portion for receiving and positioning the respective pick-up tab substantially below the track; and a second portion of the track for recovering and folding the respective pick-up tab as the respective filter bag passes the recess, thus positioning the respective pick-up tab between the respective filter bag and the second portion of the track close to a sealed end of the respective filter bag.

8. The machine according to claim 7, wherein the respective pick-up tab is attached to the sealed end by heat-sealing in the station for attaching the pick-up tab.

9. The machine according to claim 7 or 8, wherein the station for attaching the respective pick-up tab comprises a pair of rollers located on opposite sides of a transit track disposed downstream of the folding unit, one of the rollers forming a sealing element, synchronized with filter bag feed, and having a sealing sector for applying a sealing compression to the respective pick-up tab and the sealed end of the filter bag, and the other of the rollers forming a contrast for the sealing element and turning in the direction of feed.

10. The machine according to claim 1, wherein the attachment station comprises a heat-sealing unit for attaching the respective pick-up tab to the respective section of the thread.

11. The machine according to claim 1, wherein the thread unwinding station comprises another wheel having means for forming a thread unwinding pattern, said another wheel turning about its axis in a direction to transport the respective section of the thread to the attachment station; the attachment station comprising:

a reel for feeding a continuous web of pick-up tabs;

a unit for forming and positioning the respective pick-up tab;

means for folding the respective pick-up tab over itself and the respective section of the thread; and a unit for heat-sealing the respective pick-up tab folded over the respective section of the thread.

12. The machine according to claim 11, wherein the unit for forming and positioning the respective pick-up tab comprises a set of motor-driven rollers for feeding in synchronization with the thread unwinding station a preset quantity of the continuous web of pick-up tabs equivalent to a single pick-up tab to a feed track extending into a thread transit zone, said thread transit zone having:

a fork for supporting the continuous web of pick-up tabs; and synchronized cutting means for defining the respective pick-up tab.

13. The machine according to claim 12, wherein the folding means comprises a plate located below the fork, the plate being mobile between a lowered, non-operating position, in which the fork is distanced from the respective pick-up tab, and a raised, operating position, in which the plate intercepts and folds the respective pick-up tab into an inverted V configuration for receiving the respective section of the thread therebetween.

14. The machine according to claim 12, wherein the set of motor-driven rollers and the cutting means are separated by an accumulation unit for the continuous web of pick-up tabs unwinding the preset quantity of the web; and wherein the unit for forming and positioning further comprises a stepping thrust means located at the feed track for feeding the web towards the cutting means in synchronization with said cutting means.

15. The machine according to claim 11, wherein the heat-sealing unit comprises a pair of rotating rollers; one roller being the sealing roller and the other being the contrast roller; said pair of rollers being located close to and above the supporting fork.

16. The machine according to claim 15, wherein one of the rollers of the heat-sealing unit has a pair of opposite recesses on its cylindrical surface forming passage of a further section of the thread.

* * * * *